US007117888B2

(12) United States Patent
Niekolaas

(10) Patent No.: US 7,117,888 B2
(45) Date of Patent: Oct. 10, 2006

(54) HYDRAULIC SEPARATOR

(75) Inventor: Simon Eduard Niekolaas, Schipluiden (NL)

(73) Assignee: Flamco B.V., Gouda (NL)

( * ) Notice: Subject to any disclaimer, the term of this patent is extended or adjusted under 35 U.S.C. 154(b) by 0 days.

(21) Appl. No.: 11/264,379

(22) Filed: Nov. 2, 2005

(65) Prior Publication Data

US 2006/0102558 A1 May 18, 2006

(30) Foreign Application Priority Data

Jun. 30, 2004 (NL) ..... 1026533
May 18, 2005 (EP) ..... 05076170

(51) Int. Cl.
*F16L 41/00* (2006.01)

(52) U.S. Cl. ..... 137/561 A; 137/340; 137/545; 137/565.33

(58) Field of Classification Search ..... 137/561 A, 137/561 R, 340, 565.33
See application file for complete search history.

(56) References Cited

U.S. PATENT DOCUMENTS 1,522,827 A * 1/1925 Moneuse ..... 137/340
4,505,297 A * 3/1985 Leech et al. ..... 137/561 A
5,074,331 A * 12/1991 Kassarjian ..... 137/561 A
5,209,765 A * 5/1993 Kolpak et al. ..... 96/157
5,407,274 A * 4/1995 Woerheide et al. ..... 366/337
6,354,318 B1 * 3/2002 Butler ..... 137/2

FOREIGN PATENT DOCUMENTS

DE 44 07 807 A1 9/1995
FR 2 737 282 A1 1/1997

* cited by examiner

*Primary Examiner*—A. Michael Chambers
(74) *Attorney, Agent, or Firm*—Browdy and Neimark, PLLC

(57) ABSTRACT

The invention relates to a hydraulic separator to be fitted between a primary liquid circuit and a secondary liquid circuit, in such a manner that the first and secondary liquid circuits are hydraulically independent. The hydraulic separator has an elongate body with an internal space which is delimited by a wall. In the internal space there is a feed port leading to the primary liquid circuit and a discharge port leading from the primary liquid circuit, which are located substantially on one longitudinal side of the hydraulic separator. Also in the internal space there is a feed port leading to the secondary liquid circuit and a discharge port leading from the secondary liquid circuit, which are located substantially on a different longitudinal side of the hydraulic separator. The feed port leading to the primary liquid circuit and the discharge port leading from the secondary liquid circuit are located substantially at a first height region of the hydraulic separator. The discharge port leading from the primary liquid circuit and the feed port leading to the secondary liquid circuit are located substantially at a different, second height region of the hydraulic separator. In the internal space of the hydraulic separator, both in the first height region and in the second height region, there is a set of open filler bodies which have a large surface area in relation to the volume which they take up.

8 Claims, 4 Drawing Sheets

HYDRAULIC SEPARATOR

The present invention relates to a hydraulic separator, to be fitted between a primary liquid circuit and a secondary liquid circuit, in such a manner that the first and secondary liquid circuits are hydraulically independent. The hydraulic separator has an elongate, preferably vertically positioned body with an internal space which is delimited by a wall and in which at least the following components are arranged: a feed port leading to the primary liquid circuit and a discharge port leading from the primary liquid circuit, which are located substantially on one longitudinal side of the hydraulic separator, and a feed port leading to the secondary liquid circuit and a discharge port leading from the secondary liquid circuit, which are located substantially on a different longitudinal side of the hydraulic separator. In this arrangement, the feed port leading to the primary liquid circuit and the discharge port leading from the secondary liquid circuit are located substantially at a first height region of the hydraulic separator. The discharge port leading from the primary liquid circuit and the feed port leading to the secondary liquid circuit are located substantially at a different, second height region of the hydraulic separator.

If a primary liquid circuit, equipped with one or more pumps, together with a secondary liquid circuit with one or more pumps, are present in a single system for heating and/or cooling, working conditions may arise which cause the pumps to act on one another and thereby to abnormally influence the flow rates and working heads of the liquid circuits. A hydraulic separator arranged in the manner described above creates a liquid region with a limited resistance, with the result that the first and secondary liquid circuits which are coupled to the hydraulic separator become hydraulically independent. The flow rate passing through a circuit then depends exclusively on the flow rates of the associated pumps, since the limited resistance in the hydraulic separator ensures that flow in one liquid circuit does not cause any flow in the other circuit. By way of example, if the pumps in the secondary liquid circuit require a greater flow rate, liquid will flow from the discharge of the secondary liquid circuit to the feed of the secondary liquid circuit. Heating and/or cooling systems of this type are used in particular in systems in which a plurality of boilers are connected in a cascade arrangement and/or in which a plurality of delivery systems with a dedicated pump are present. In known heating and cooling systems, there is a temperature gradient in the hydraulic separator. By way of example, in a heating system one or more boilers and pumps are incorporated in the primary liquid circuit, and a plurality of radiators, each provided with dedicated pumps, are arranged in the secondary liquid circuit. If the flow rates of all the pumps are completely matched to one another, cold liquid will flow through the feed port leading to the primary liquid circuit and the discharge port leading from the secondary liquid circuit, and hot liquid will flow through the discharge port leading from the primary liquid circuit and the feed port leading to the secondary liquid circuit. A certain amount of mixing will occur in the hydraulic separator. This mixing causes heat to be lost and leads to an undesirable loss of efficiency in the system.

The object of the present invention is to provide a hydraulic separator of the abovementioned type in which the efficiency loss is reduced.

This object is achieved by a device according to the invention. In this device, there is a set of open filler bodies which have a large surface area in relation to the volume which they take up both at the first height region and at the second height region of the internal space of the hydraulic separator. These sets form a resistance to the flow of liquid. This lowers the liquid flow rate in the hydraulic separator: both the flow rate at one height region and from one height region to the other. Lowering the flow rate reduces the mixing which occurs in the hydraulic separator, thereby lowering the loss of efficiency. By way of example, the efficiency is improved from 85% to 95%. As a result of this lower flow rate, hydraulic separators of a shorter length than is usual can achieve a satisfactory efficiency.

In a preferred embodiment, there is a free space without filler bodies between the first height region and the second height region. The sets of open filler bodies are then located only at the level of the feed and discharge ports. This is advantageous since otherwise the resistance in the hydraulic separator can become too great, with the result that there are no longer any bypass options and the systems become hydraulically dependent.

It is preferable for the open filler bodies to be in the form of hollow cylindrical bodies comprising a cylindrical wall provided with openings and projections which extend inwards from the wall. These bodies are known per se. By way of example, these bodies are PALL rings.

It is advantageous for these sets of open filler bodies to be arranged in a cage. This cage may simply be placed as a unit into the hydraulic separator. The cage is more advantageously block-shaped, in which case the sides between the feed port and the discharge port are shorter than the other sides, so that the flow of liquid is not subject to resistance as soon as it flows into the hydraulic separator.

In a preferred embodiment, a vent is fitted to the hydraulic separator. The large surface area of the open filler bodies in relation to the volume which they take up means that any air that is present in the system is collected in these filler bodies. The air will collect at the top of the hydraulic separator. If a vent is positioned here, this air can be discharged from the system.

More advantageously, a tap is fitted at the underside of the hydraulic separator. Any dirt which may be present and settles at the bottom of the hydraulic separator can be discharged through this tap.

The invention will be explained in more detail below with reference to the drawing, in which.

FIG. 3 shows a number of views of a set of open filler bodies 20 and a cage for accommodating the filler bodies, FIG. 4 shows an exemplary embodiment of a known hydraulic separator and a hydraulic separator according to the invention, illustrating the temperature distribution, and FIG. 5 shows an exemplary embodiment of a known hydraulic separator and a hydraulic separator according to the invention, illustrating the flow rate distribution.

Figure 1:
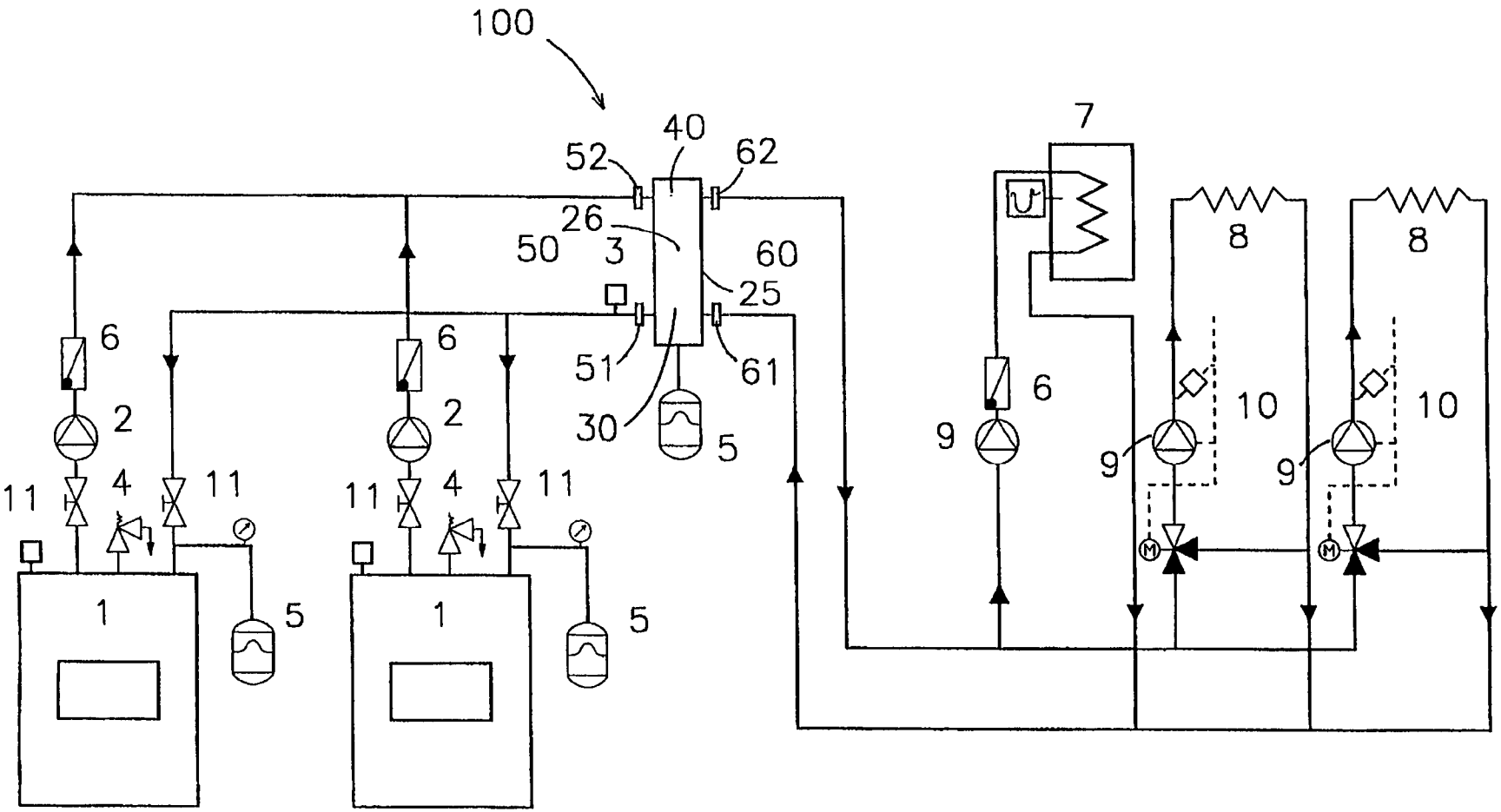
FIG. 1 shows a heating system in which there is a hydraulic separator.

FIG. 1 depicts a heating system 100 in which there is a hydraulic separator 3. The hydraulic separator 3 is fitted between a primary liquid circuit 50 and a secondary liquid circuit 60, in such a manner that the primary liquid circuit 50 and secondary liquid circuit 60 are hydraulically independent. The hydraulic separator 3 has an elongate body with an internal space 26 delimited by a wall 25. A feed port 51 leading to the primary liquid circuit 50 and a discharge port 52 leading from the primary liquid circuit 50 are arranged in the wall 25, on the same longitudinal side of the hydraulic separator 3. A feed port 62 leading to the secondary liquid circuit 60 and a discharge port 61 leading from the secondary liquid circuit 60 are also arranged in the wall, on the same longitudinal side but the opposite longitudinal side from the one on which the feed and discharge ports 51 and 52 of the primary liquid circuit 60 are located. The feed port 51 leading to the primary liquid circuit 50 and the discharge port 61 leading from the secondary liquid circuit 60 are located at a first height region 30 of the hydraulic separator 3. The discharge port 52 leading from the primary liquid circuit 50 and the feed port 62 leading to the secondary liquid circuit 60 are located at a different, second height region 40 of the hydraulic separator 3.

In the system 100 illustrated by way of example, the primary liquid circuit 50 is equipped with heating boilers and burners 1, safety valves 4, purge valves 11, anti-thermosyphon valves 6, expansion tanks 5 and two pumps 2. The secondary liquid circuit 60 comprises a boiler 7 and an anti-thermosyphon valve 6, heating circuits 8 with control means 10 and pumps 9. An example in which liquid in the hydraulic separator 3 will flow from the discharge port 61 of the secondary liquid circuit 60 to the feed port 62 of the secondary liquid circuit 60 is if a heating circuit 8 is suddenly opened. A pump 9 will then require an additional flow of liquid, while the pumps 2 in the primary liquid circuit 50 do not yet allow this directly.

Figure 2:
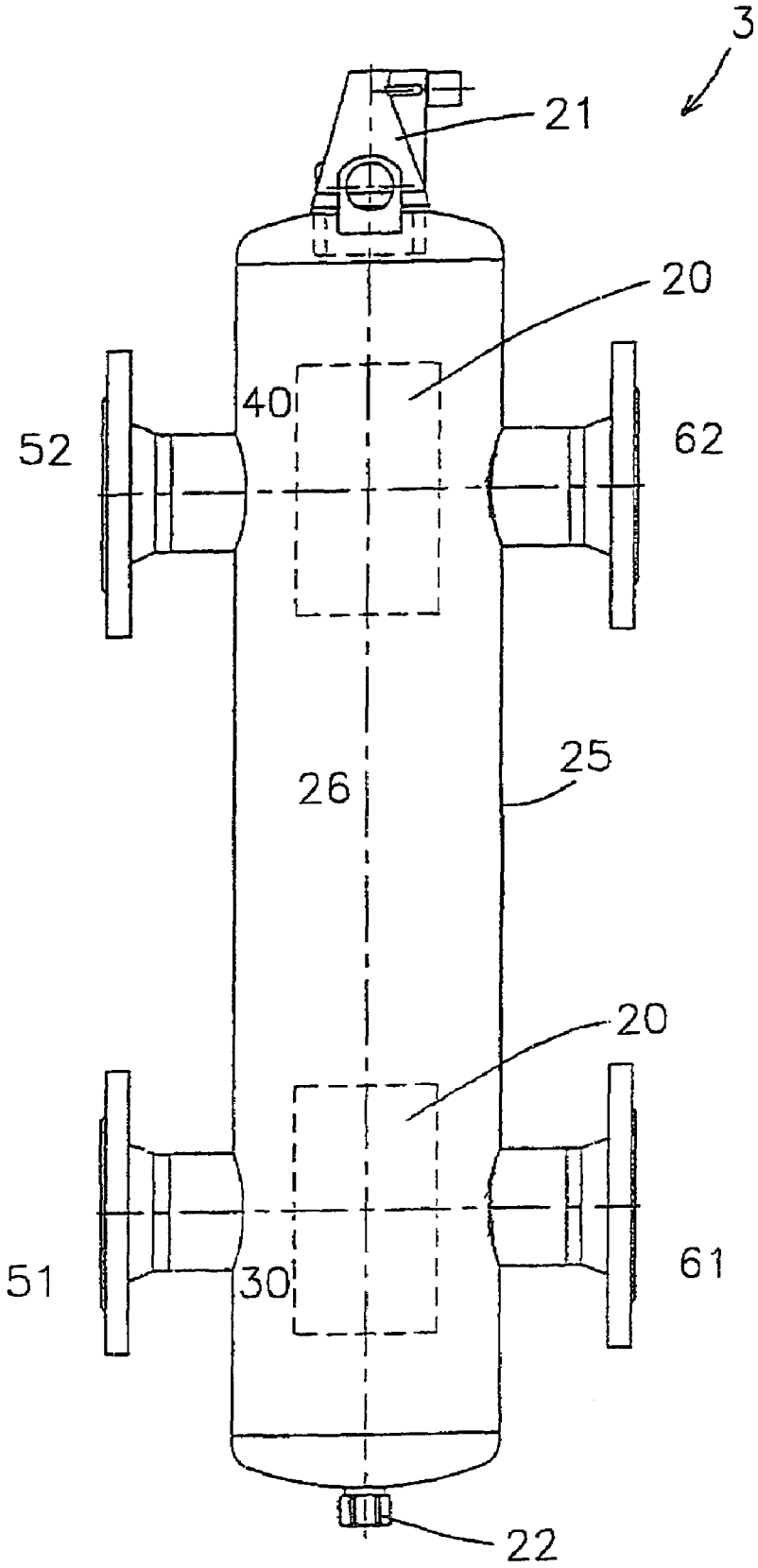
FIG. 2 shows a hydraulic separator according to the invention.

FIG. 2 shows a hydraulic separator 3 according to the invention, as can be implemented for example in the system 100. Identical components are denoted by identical reference numerals. This figure diagrammatically depicts sets of open filler bodies 20 at the first height region 30 and at the second height region 40. A free space without filler bodies is present between the first height region 30 and the second height region 40. These filler bodies 20 have a large surface area in relation to the volume which they take up. A vent 21 is fitted at the top side of the hydraulic separator 3. On account of the large surface area of the open filler bodies in relation to the volume which they take up, any air which may be present in the system is collected in these filler bodies. The air will collect at the top of the hydraulic separator 3 and can be discharged from the system by the vent 21. The hydraulic separator 3 is closed by a knob 22. A removal valve can also be fitted here.

Figure 3E:
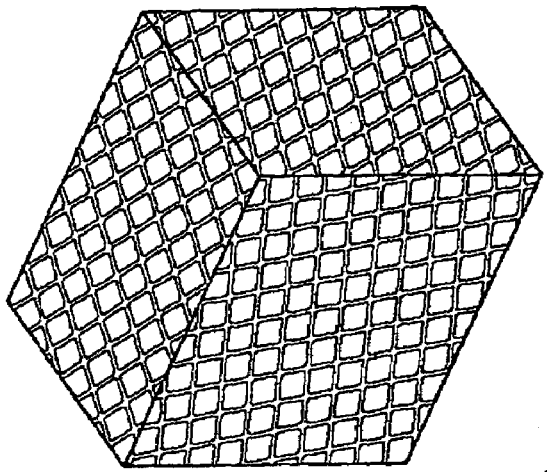
Figure 3D:
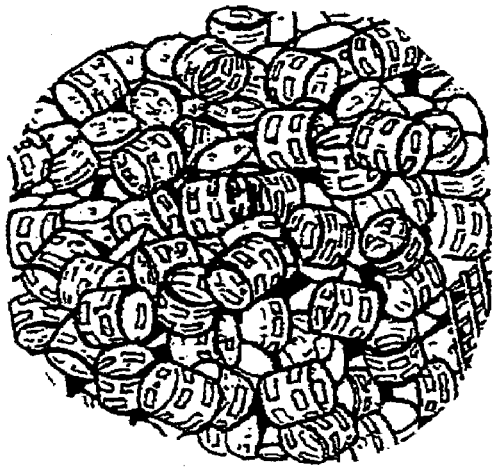
Figure 3A:
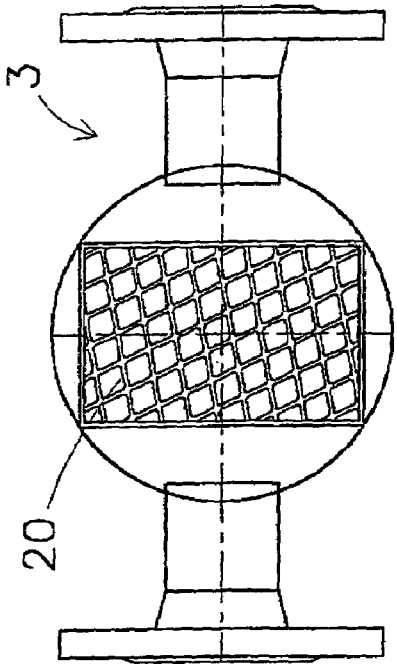
Figure 3C:
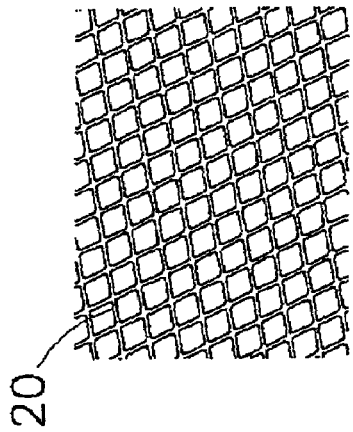
Figure 3B:
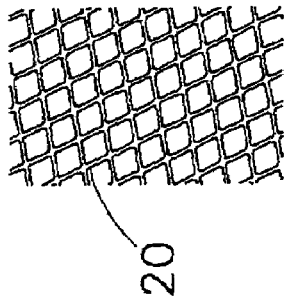

FIG. 3*a* diagrammatically depicts a plan view of a set of open filler bodies 20 in the hydraulic separator 3. FIGS. 3*b* and 3*c* respectively show a side view and a front view of the set of open filler bodies 20. FIG. 3*d* shows PALL rings which can be used as sets of open filler bodies. It is advantageous for these sets of open filler bodies 20 to be arranged in a cage. FIG. 3*e* shows a cage which can be used. This cage can simply be placed as a unit in the hydraulic separator 3.

Figure 4A:
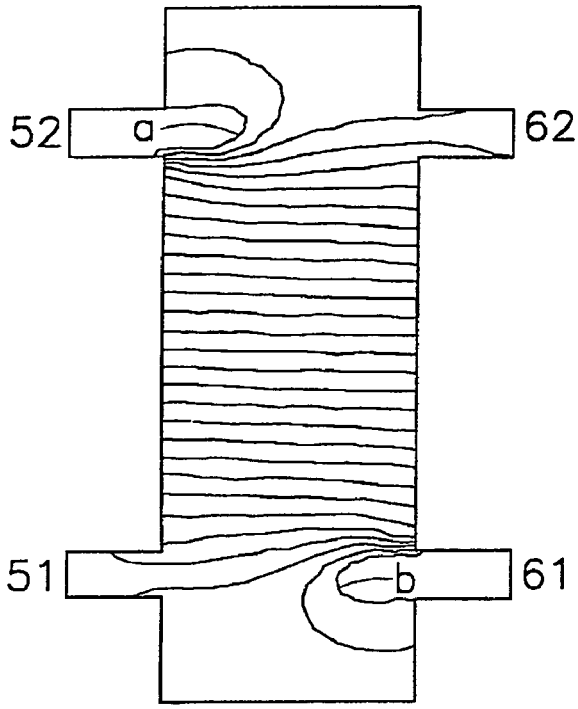
Figure 4B:
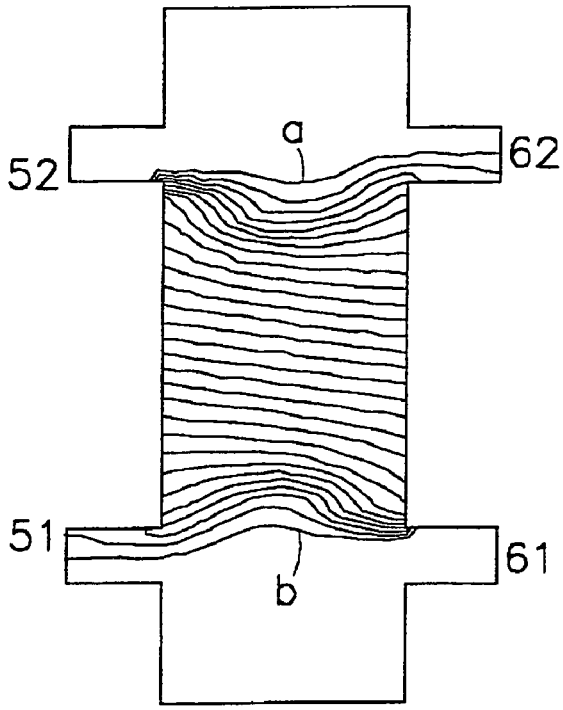

FIGS. 4*a* and 4*b* diagrammatically depict two hydraulic separators together with the feed and discharge ports. FIG. 4*a* shows an exemplary embodiment of a known hydraulic separator, and FIG. 4*b* shows an exemplary embodiment of a hydraulic separator according to the invention. In FIGS. 4*a* and 4*b*, isotherms are used to indicate the temperature distribution in the respective hydraulic separators. The isotherm a is located at the highest temperature, and the isotherm b is located at the lowest temperature. The intervening isotherms are arranged at equal temperatures in both figures. These figures clearly show that the temperature profile in the hydraulic separator between the discharge port 52 leading from the primary liquid circuit 50 and the feed port 62 leading to the secondary liquid circuit 60 is lower in the hydraulic separator according to the invention than in the known hydraulic separator. The same applies to the temperature profile between the discharge port leading from the second circuit 60 and the feed port 51 leading to the primary liquid circuit 50.

Figure 5A:
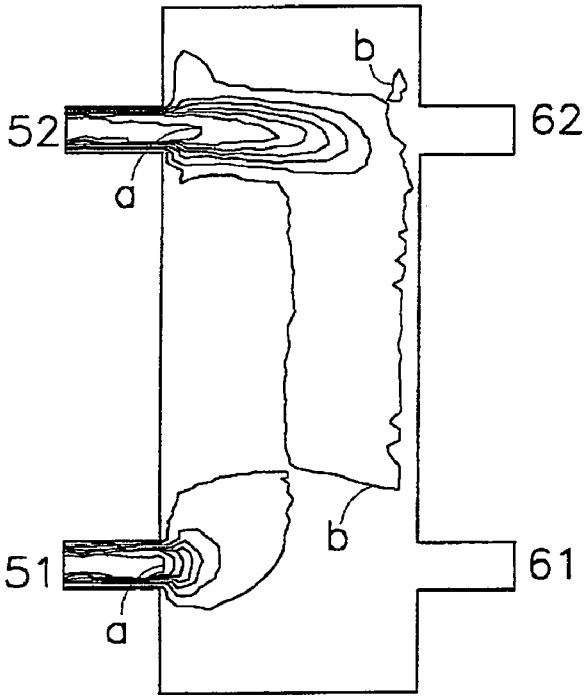
Figure 5B:
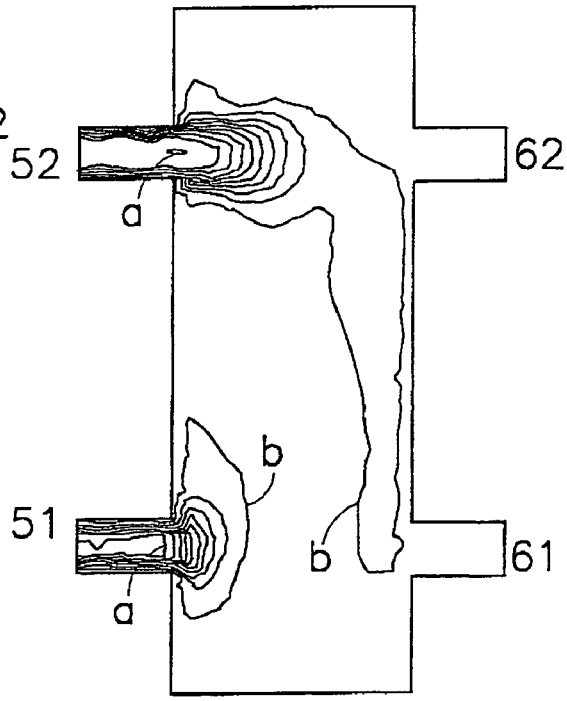

FIG. 5 diagrammatically depicts two hydraulic separators together with the feed and discharge ports. FIG. 5*a* shows an exemplary embodiment of a known hydraulic separator, and FIG. 5*b* shows an exemplary embodiment of a hydraulic separator according to the invention. In FIGS. 5*a* and 5*b*, lines with the same flow rate indicate the distribution of the flow rate in the respective hydraulic separators. Line a is positioned at the highest flow rate and line b at the lowest flow rate. The intervening lines are arranged at the same flow rates in both figures. These figures clearly show that the flow rate in the centre of the hydraulic separator is lower in the hydraulic separator according to the invention than in the known hydraulic separator.

The invention claimed is:

1. Hydraulic separator to be fitted between a primary liquid circuit and a secondary liquid circuit, in such a manner that the first and secondary liquid circuits are hydraulically independent, which hydraulic separator has an elongate body with an internal space which is delimited by a wall and in which at least the following are arranged:

a feed port leading to the primary liquid circuit and a discharge port leading from the primary liquid circuit, which are located substantially on one longitudinal side of the hydraulic separator, and a feed port leading to the secondary liquid circuit and a discharge port leading from the secondary liquid circuit, which are located substantially on a different longitudinal side of the hydraulic separator, the feed port leading to the primary liquid circuit and the discharge port leading from the secondary liquid circuit being located substantially at a first height region of the hydraulic separator, and the discharge port leading from the primary liquid circuit and the feed port leading to the secondary liquid circuit being located substantially at a different, second height region of the hydraulic separator, characterized in that in the internal space of the hydraulic separator, both at the first height region and at the second height region, there is a set of open filler bodies which have a large surface area in relation to the volume which they take up.

2. Hydraulic separator according to claim 1, characterized in that there is a free space without filler bodies between the first height region and the second height region.

3. Hydraulic separator according to claim 1, characterized in that the open filler bodies are in the form of hollow cylindrical bodies comprising a cylindrical wall provided with openings and projections which extend inwards from the wall.

4. Hydraulic separator according to claim 1, characterized in that the set of open filler bodies is arranged in a cage.

5. Hydraulic separator according to claim 4, characterized in that the cage is block-shaped, with the sides between the feed port and the discharge port being shorter than the other sides.

6. Hydraulic separator according to claim 1, characterized in that a vent is fitted to the hydraulic separator.

7. Hydraulic separator according to claim 1, characterized in that a tap is fitted to the hydraulic separator.

8. System comprising a primary liquid circuit and a secondary liquid circuit, between which there is arranged a hydraulic separator according to claim 1.

* * * * *

UNITED STATES PATENT AND TRADEMARK OFFICE

CERTIFICATE OF CORRECTION

PATENT NO. : 7,117,888 B2
APPLICATION NO. : 11/264379
DATED : October 10, 2006
INVENTOR(S) : Simon Eduard Niekolaas It is certified that error appears in the above-identified patent and that said Letters Patent is hereby corrected as shown below:

Title page, delete the entirety of Section (30) Foreign Application Priority Data, including reference to both foreign patent applications within that section.

Signed and Sealed this
Seventeenth Day of January, 2012

David J. Kappos

David J. Kappos
*Director of the United States Patent and Trademark Office*